US005125175A

United States Patent [19]

Huff, Jr.

[11] Patent Number: 5,125,175

[45] Date of Patent: Jun. 30, 1992

[54] CHILDREN'S WATERPROOF, SAFETY PICTURE FRAME

[76] Inventor: Howard C. Huff, Jr., 1502 Stag Point, San Antonio, Tex. 78248

[21] Appl. No.: 580,950

[22] Filed: Sep. 11, 1990

[51] Int. Cl.[5] ..... G09F 1/12

[52] U.S. Cl. ..... 40/152; 40/157

[58] Field of Search ..... 446/419; 296/93; 606/235; 40/152, 156, 157, 158.1; 52/204, 206, 208, 403, 308, 656, 658, 475–477

[56] References Cited

U.S. PATENT DOCUMENTS

| | | | |
|---|---|---|---|
| 2,533,978 | 12/1950 | Versosa | 40/152 |
| 2,766,757 | 10/1956 | Zelony | 606/235 |
| 3,200,527 | 8/1956 | Clark | 40/152 |
| 4,583,309 | 4/1986 | Kane et al. | 40/152 |
| 4,761,903 | 8/1988 | Cantrell | 40/152 |
| 4,816,003 | 3/1989 | Yip et al. | 606/235 |
| 4,846,523 | 7/1989 | Whitaker, Jr. | 52/308 |

FOREIGN PATENT DOCUMENTS

| | | | |
|---|---|---|---|
| 2136623 | 9/1984 | United Kingdom | 40/152 |

*Primary Examiner*—Kenneth J. Dorner
*Assistant Examiner*—Milton Nelson, Jr.
*Attorney, Agent, or Firm*—Gunn, Lee & Miller

[57] ABSTRACT

A picture frame (10) for safe handling by children having a front subframe (12) and rear subframe (18) with smooth, substantially unbroken outer surfaces which sandwich a transparent sheet (14) against which the picture (16) is placed. The picture (16) is sealed such that moisture under normal atmospheric conditions cannot reach it.

2 Claims, 14 Drawing Sheets

CHILDREN'S WATERPROOF, SAFETY PICTURE FRAME

FIELD OF THE INVENTION

This invention relates to a picture frame specifically designed to protect pictures from harmful external elements such as children through its sealed structure while also allowing the use and handling by children without harm or injury to the children, picture or picture frame.

BACKGROUND OF THE INVENTION

Many different types and styles of picture frames are available for displaying pictures and art, including those made of wood, metal, plastic, ceramic, acrylic and glass with glass, plexiglass or similar transparent viewing panes. The construction and design of these frames do not allow for the use and enjoyment by children without a high risk of injury to the child or damage to the picture or frame. Today there is a demand and need for a picture frame which is designed to allow enjoyment by children without a safety risk or risk of damage to the frame or picture, heretofore associated with the present frames.

Previously issued patents have addressed the protection of pictures from outside elements.

In U.S. Pat. No. 3,442,041, a photograph is inserted between two halves of a transparent plastic sheet and coated with pressure-sensitive adhesive and folded in the middle. The photograph is permanently sealed to both its front and back faces with the folded plastic being larger in both dimensions than the photograph. However, the photograph is irreversibly sealed, not suitable for hanging and not suitable for use by a child without the risk of damage to the picture or the child.

U.S. Pat. No. 3,505,140 describes a means for protecting a picture using a card-like transparent plastic sheet coated with an adhesive and joined by a hinge. However, the pictures are irreversibly sealed and the device is not suitable for handling by children without risk of damage to the frame or injury to the children.

U.S. Pat. No. 4,761,903 describes a waterproof display frame that utilizes a water-impermeable sheet to seal pictures onto a rigid plate. Again, this design is not suitable for handling by children without the risk of injury to the child or damage to the picture or frame.

These patents rely on various different methods of protecting pictures which include an adhesive-backed, water-impermeable sheet.

The design of this invention incorporates a frame with a rounded perimeter, rounded cross-section, and a shatter-proof, light-transparent viewing sheet with a sealing means within the frame structure and matting if desired. This unique design allows the viewing and handling of pictures with protection to the pictures from external elements and with minimal risk of injury to the child. External elements include water, saliva, food and liquids, dirt, harmful gases and vapors, and other elements or contaminants hazardous to pictures.

The unique design of the present invention will further allow the use and enjoyment of pictures by children at home and at locations including day-care centers, schools, other homes, and vacations away from home. The ability of children to enjoy pictures of family, friends, pets and the like within their own stage of development can promote family values and provide emotional security while the child is away from family or home.

The unique design of the present invention also allows the renewal and replacement of photographs or pictures within the frame without damaging them.

This invention also provides a means of displaying pictures, art or the like as described above at a reasonable cost. The unique design of the frame allows objects to be safely displayed and handled at locations not heretofore available.

This invention is suitable for use as a substitute to frame designs not intended for use by children by affording protection to displayed pictures from contaminants, handling and accidents.

The challenge of designing a frame to meet the obstacles presented by a child's use has resulted in a frame that has significant additional applications beyond its originally designed purpose.

SUMMARY OF THE INVENTION

The invention consists of a combination of four major components: a shatterproof, rigid or semi-rigid transparent viewing sheet, a front subframe structure, one or more rubber or soft pliable seals, and a rear subframe. The four components fit together to create a picture frame that is unique, in part, in that the external surface is smooth. Smooth means without sharp corners or edges which could injure a child.

The front subframe may be generally square, rectangular, triangular, round, or another multiple-sided configuration with the "soft" or rounded edges between the sides. The front subframe has rounded corners to prevent injury and is substantially rounded in cross-section. The front subframe can be constructed of plastic, rubber, metal, wood, or other traditional materials alone or in combination.

The shatterproof, non-opaque viewing sheet is placed into the front subframe structure from the rear, resting on a sunken lip in the inner surface of the front subframe. The sheet will be dimensioned to fit flush against the outer border surrounding the sunken lip. The non-opaque sheet may be sealed to the front frame structure by conventional sealing means such as sealing glues (for example, a silicone sealer) or a rubber gasket type seal. The non-opaque sheet may or may not be sealed or permanently attached to the front frame structure. The non-opaque sheet may also be a formed molded part of the front frame structure integral with or attached permanently to the front frame structure.

The sealing of a picture within the frame structure is accomplished by use of a continuous rubber gasket, o-ring gasket, or rubber seal with the specific configurations dependent upon style and size of frame. Liquid sealants such as silicone sealer may also be used.

The term "picture" is defined to include photographs, art works, drawings, newspaper clippings, announcements, documents, awards, diplomas, and other primarily two-dimensional objects. The picture should be smaller than the dimensions of the rubber gasket or sealing ring but is preferable not to be smaller than the inside border of the sunken lip of the front subframe. Pictures to be enclosed in frames of non-traditional shape or size may require the trimming of their edges to allow a proper fit and seal.

The rear subframe, like the front subframe, has a smooth outer surface. It is dimensioned to fit within the lip of the front subframe. The rear subframe is then attached to the front subframe plate by means of threads, screws, or by snapping together of front and rear subframe structure with integral snap means.

The picture frame may be provided with a variety of shapes—round, rectangular, triangular or animal shapes and the like—while still incorporating the unique features of the present invention.

The unique features of the present invention provide picture frames that are suitable for use in nautical environments.

DETAILED DESCRIPTION OF THE PREFERRED EMBODIMENT

Figure 1A:
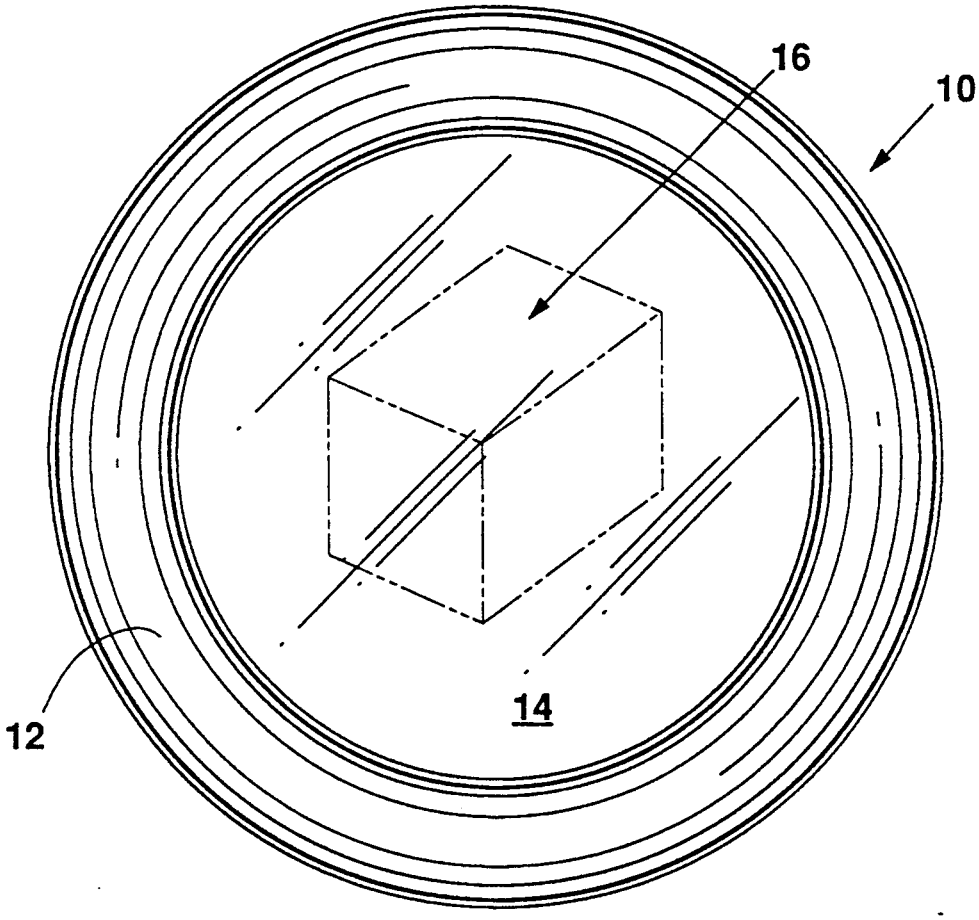
FIG. 1*a* is a front elevational view of the picture frame in the round embodiment.
Figure 1B:
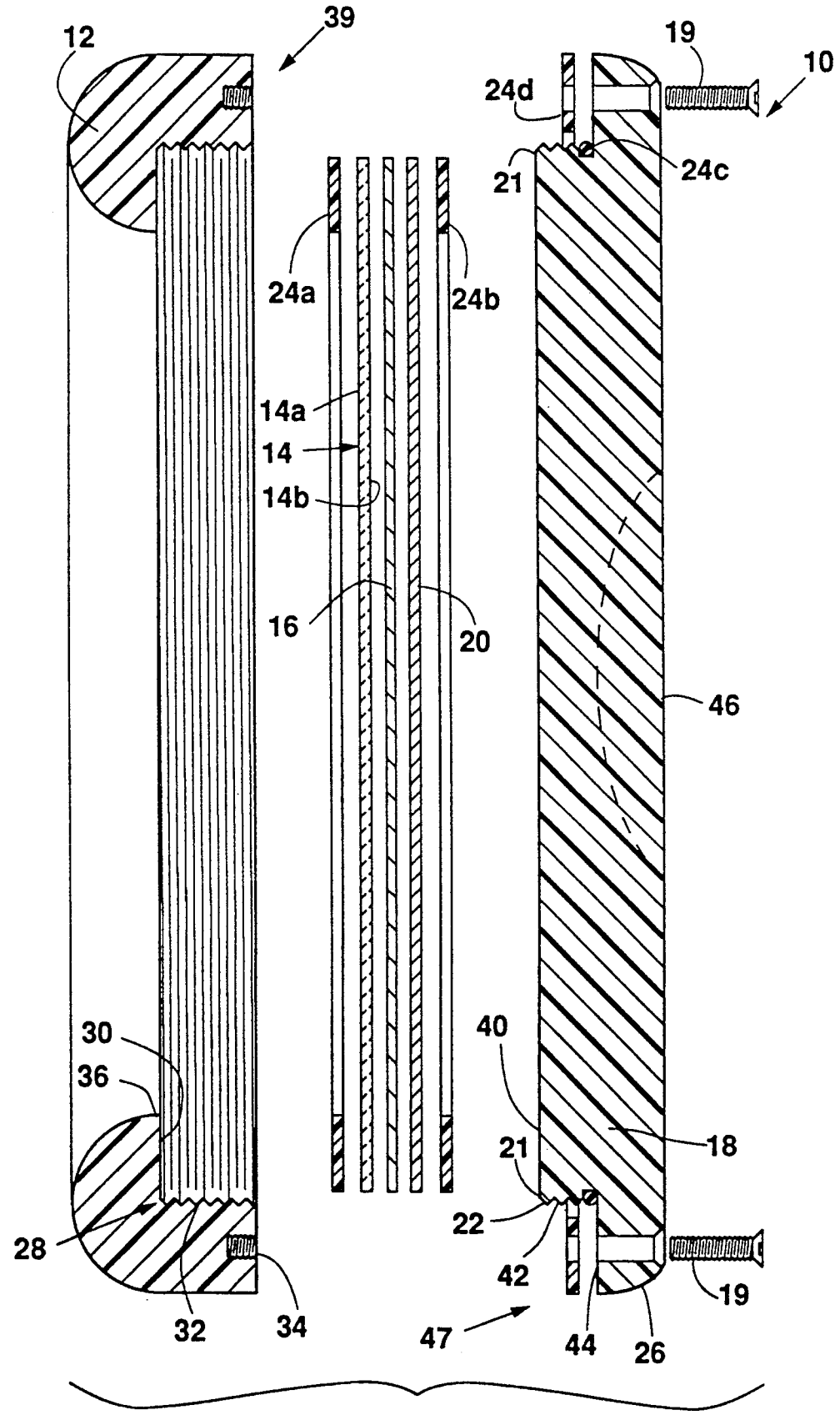
FIG. 1*b* is an exploded side view in cross-section of the picture frame in the round embodiment.
Figure 1C:
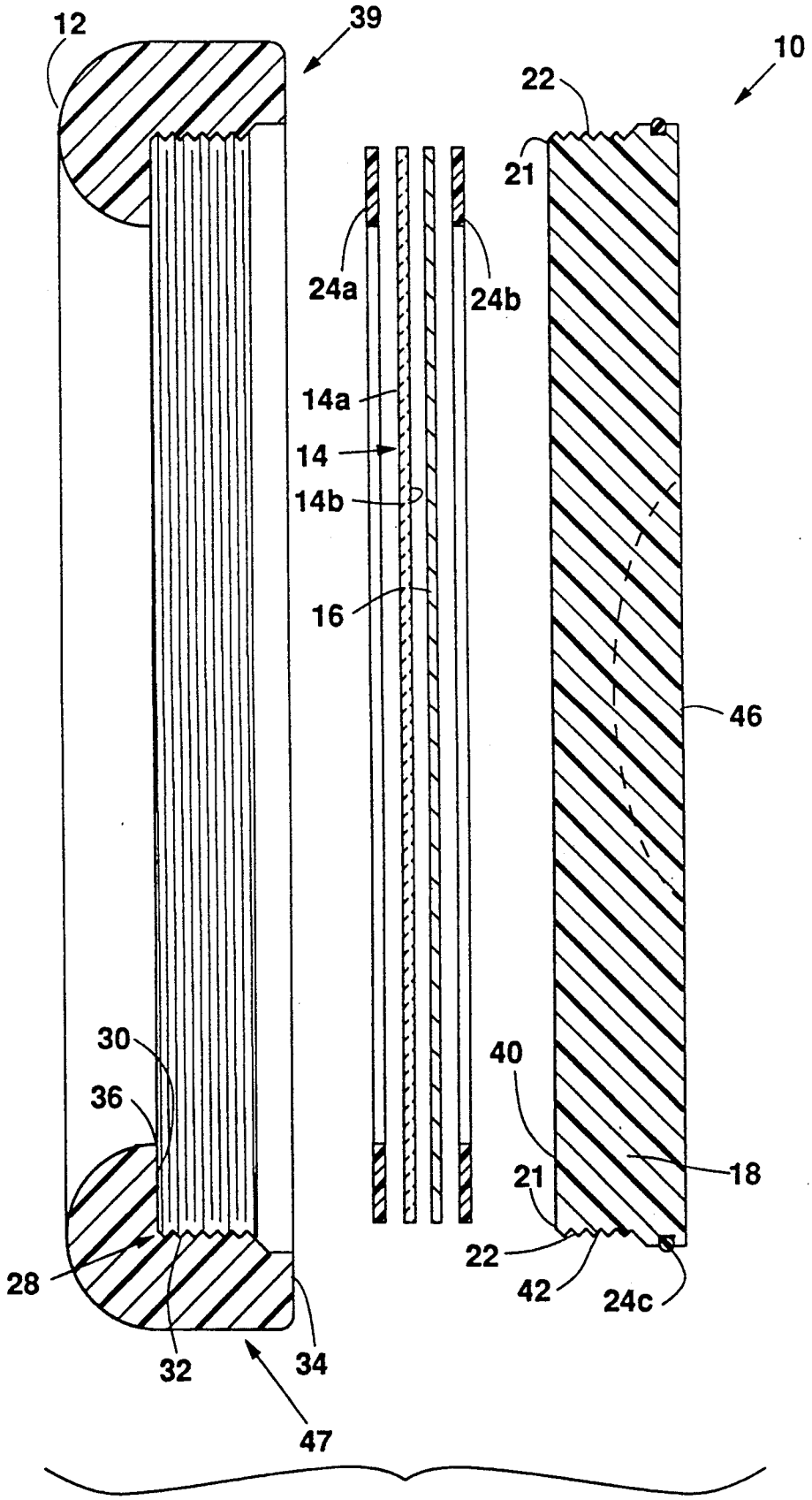
FIG. 1*c* is an exploded side view in cross-section of the picture frame in the round embodiment without a lip.

FIGS. 1*a*–1*c* illustrate a round configuration of the picture frame. More specifically, FIGS. 1*a*–1*c* illustrate the picture frame (10) with front subframe (12) and transparent (14) (with front face (14*a*) and rear face (14*b*)). Front subframe (12) has outer surface (38) and inner surface (39) which is dimensioned to receive transparent sheet (14). Inner surface (39) is comprised of inner faces (30), (32) and (34) (FIG. 1*b*). As can be seen in FIG. 1*b*, the inner faces (30) and (32) meet in generally perpendicular relation to form notch (28). Notch (28) provides a seat for the receipt of transparent sheet (14) therein. Attachment means (19) (such as screws) or threads (22) secure front subframe (12) to rear subframe (18). Among the features novel to this invention is sealant means (24*a*–*d*) which functions to prevent water or other moisture from reaching picture (16).

Picture (16) may have a backing (20) (such as a matte surface), and is dimensioned to receive rear subframe face (40). Rear subframe faces (40), (42) and (44) together comprise the inner surface (47) of rear subframe. Rear subframe (18) is also dimensioned to be received within notch (28) snugly. The term "outer surface" is used to describe the surfaces of picture frame (10) that are visible from the outside after front subframe (12) has been mated to rear subframe (18). The term "inner surface" is used to describe those surfaces of frame (10) which are concealed from view when it is properly assembled. Thus, as seen in FIG. 1*b*, when the front subframe (12) and rear subframe (18) are attached together, they sandwich therebetween the non-transparent sheet and the picture to be viewed.

Another novel feature of this invention is the rounded nature of the front subframe outer surface (38) and rear subframe outer surface (46). That is, all embodiments of the present invention contain outer surfaces which are without sharp edges and are thus substantially smooth.

Sealant means (24) acts to prevent water, under normal or slightly greater than normal atmospheric pressure, from penetrating picture frame (10) and damaging picture (16) enclosed therein. This result is accomplished by conventional seals such as rubber gaskets, "O" rings, silicone sealant beads or in other ways disclosed herein. More specifically, sealant means (24), as viewed in FIG. 1*b*, comprises sealant means located at (24*a*) to seal perimeter of front face (14*a*) of transparent sheet (14) to front subframe inner surface (39). To prevent moisture from reaching picture (16), second sealant means is applied at either (24*b*) to seal rear subframe face (40) to rear face (14*b*) of the transparent sheet or at (24*c*) or (24*d*) to seal inner surface (47) of rear subframe (18) to inner surface (39) of front subframe (12). Thus, with the application of sealant means at two locations, transparent sheet to front subframe, and rear subframe to front subframe, at the locations illustrated, a means of preventing moisture from reaching the picture is provided. Sealant means at a single location, however, can produce the same result when the inner surface of the rear subframe is sealed to the perimeter of the rear face of the transparent sheet. It is to be understood, of course, that the sealant means is applied around the entire perimeter of the structure—be it the front subframe, the rear subframe, or the non-opaque sheet.

FIG. 1*c* illustrates the preferred embodiment as set forth in FIG. 1*b* except with the omission of lip member (26). Thus, sealant means (24) when applied to the configuration as set forth in FIG. 1*c*, may be located at (24*a*) to seal front face (14*a*) of transparent sheet (14) to face (30) of front subframe inner surface (39). In addition, sealant means at either (24*b*) or (24*c*) may be applied to seal inner surface (47) of rear subframe (18) to either rear face (14*b*) of transparent sheet (14) at (24*b*) or to face (34) at (24*c*).

Figure 2A:
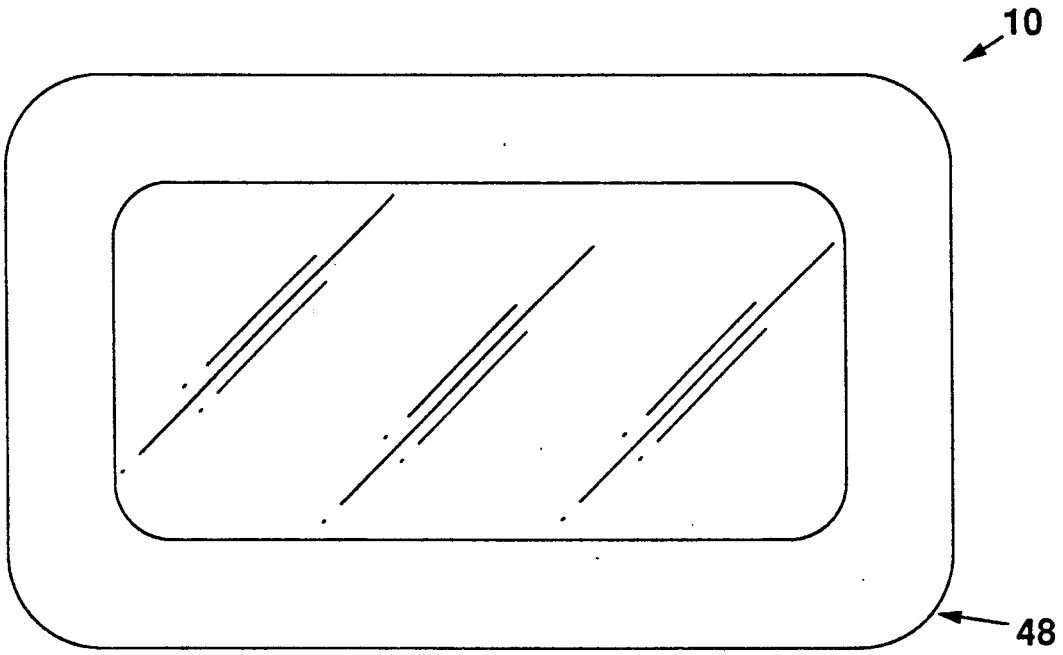
FIG. 2*a* is a front elevational view of the picture frame in the rectangular embodiment.
Figure 2B:
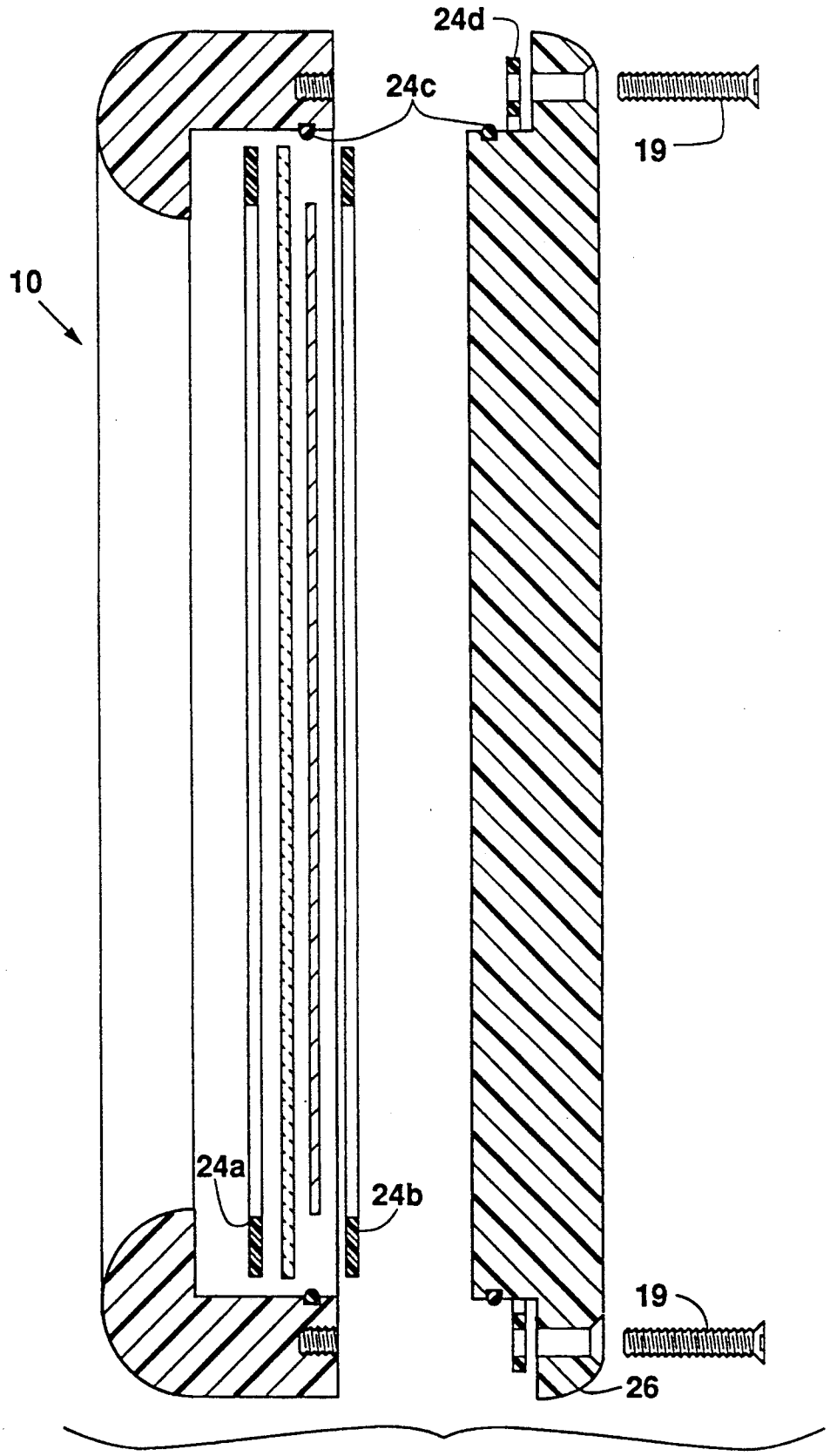
FIG. 2*b* is an exploded side view in cross-section of the picture frame in the rectangular embodiment.

Turn now to the next set of figures, FIGS. 2*a*, 2*b*, 2*c*, and 2*d*. These represent a rectangular configuration of picture frame (10). More specifically, FIG. 2*a* illustrates front subframe (12) corners (48) rounded so as to prevent injury to a child. FIGS. 2*a* and 2*b* show the general overall similarity of structure between the round embodiment and the rectangular embodiment of picture frame (10). Specifically, FIGS. 2*a*–2*d* illustrate the sealant means used to seal front subframe (12) to transparent sheet (14) and rear subframe (18). Attachment means

(19) are screws, bayonet tabs, or other releasable attachment means including latches, clips, or friction snap fittings, not easily releasable by children.

As further seen in FIGS. 2a–2d, sealant means may be located at (24a), (24b), (24c) or (24d) to help prevent water or other moisture from reaching picture (16). The preferred embodiment illustrated in FIG. 2b contains notch (28) on the inner surface (39) of rear subframe (18). Notch (28) receives the inner surface (47) of rear subframe (18) in generally flush relation. Lip (26) of rear subframe (18) lies flush against face (34) when the components of picture frame (10) are assembled such that outer surface (38) of front subframe (12) forms a smooth, flush unbroken surface with outer surface (46) of rear subframe (18). In this manner, the entire outer surface of picture frame (10) is smooth with no sharp edges or corners, and this is maintained in all smooth character views.

Figure 2C:
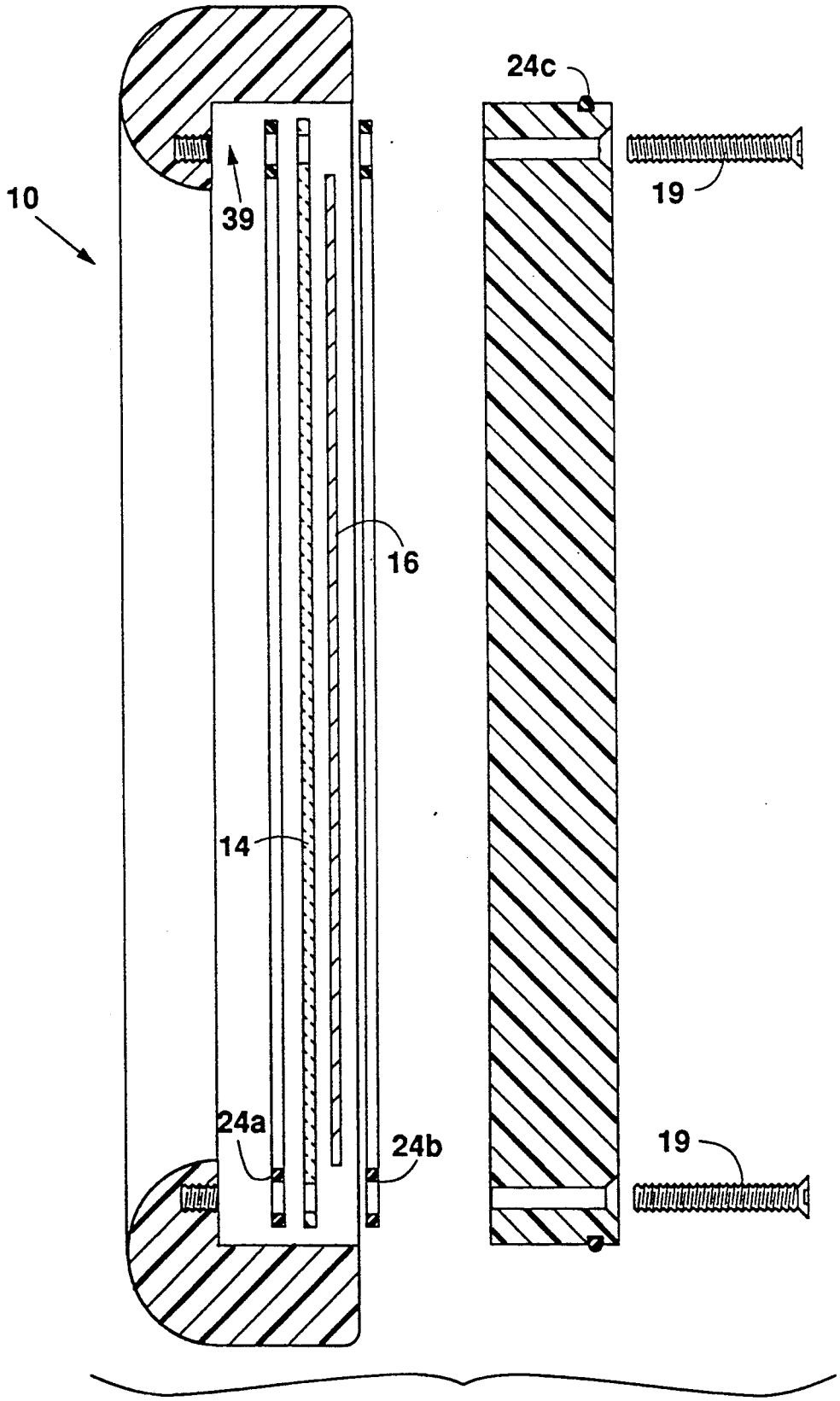
FIG. 2*c* is an exploded side view in cross-section of the picture frame in the rectangular embodiment without a lip.

FIG. 2c illustrates picture frame (10) in its rectangular embodiment in a form substantially similar to FIG. 2b except without lip (26) on rear subframe (18). Thus, sealant means would be located at either (24b) or (24a) and (24c). It is to be understood, of course, that sealant means located at (24b) would extend around the perimeter of inner surface of rear subframe (18). Likewise, sealant means at any of the locations would be continuous so as to substantially seal around all sides of picture frame (10).

Figure 2D:
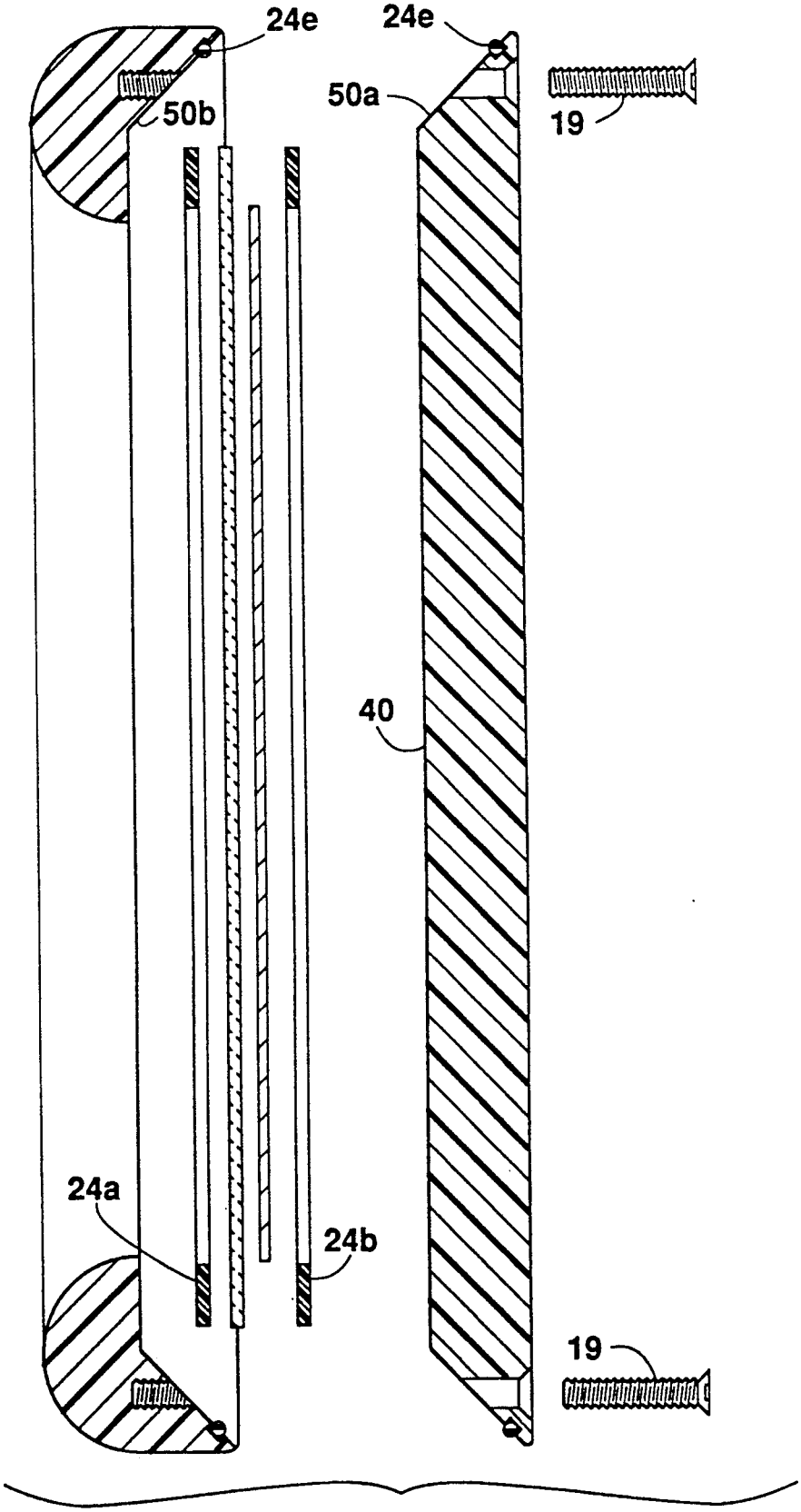
FIG. 2*d* is an exploded side view in cross-section of the picture frame in the rectangular embodiment with a beveled lip.

FIG. 2d illustrates yet another embodiment of the rectangular form of picture frame (10). Specifically, FIG. 2d illustrates picture frame (10) having bevelled, matching surfaces made up of bevelled lip (50a) and bevelled face (50b) on the corresponding inner surfaces of front subframe (12) and rear subframe (18), respectively. As with the embodiments previously set forth, single sealant means (24b) can be located around the perimeter sealing rear subframe (18) at (24b) to rear face (14b) or could be located at (24a) and (24e).

Figure 3A:
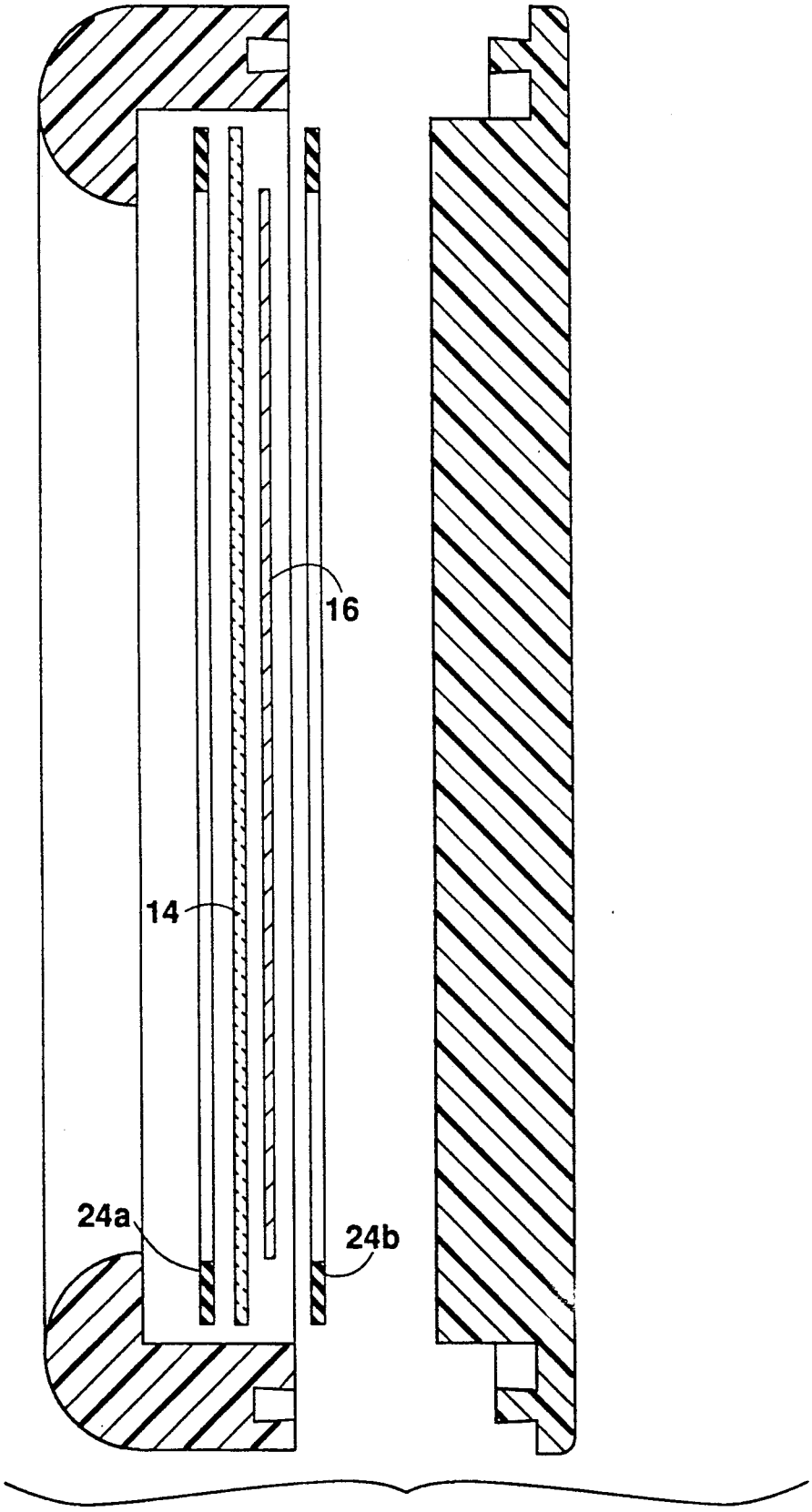
FIG. 3*a* is an exploded side view in cross-section of another preferred embodiment of the picture frame with a first attachment integral/sealing means.
Figure 3B:
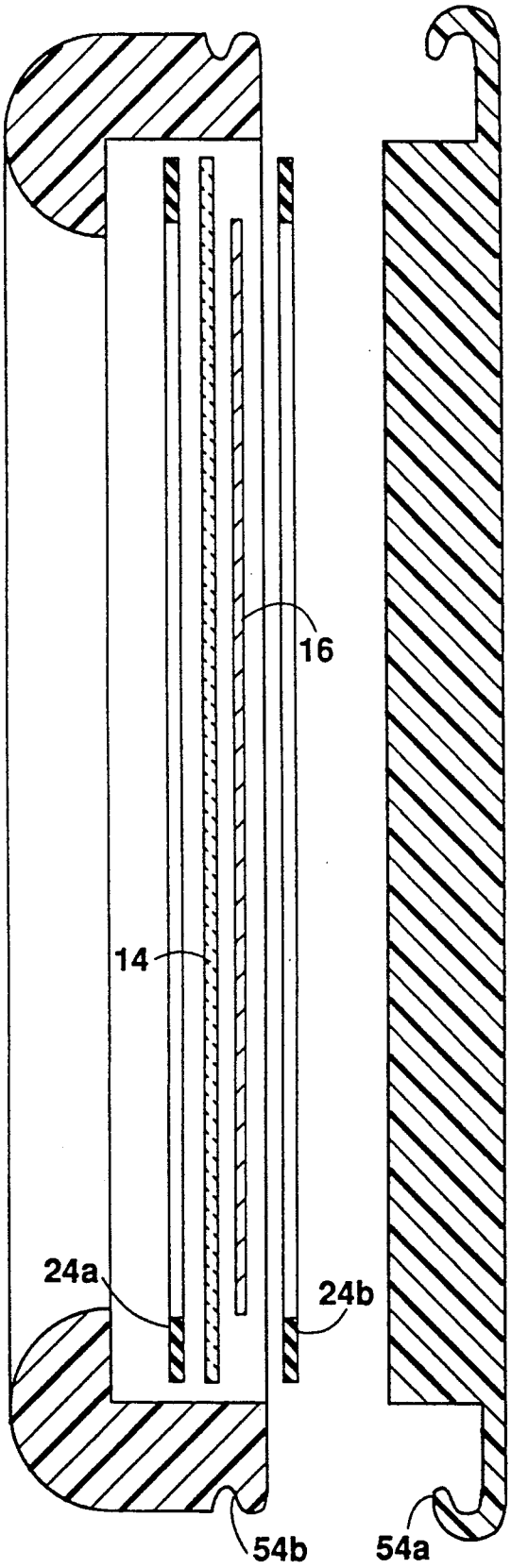
FIG. 3*b* is an exploded side view in cross-section of another preferred embodiment of the picture frame with a second attachment integral/sealing means.

FIGS. 3a and 3b illustrate another preferred embodiment of picture frame (10) with sealant means comprising integral sealing/attachment means (52) which contain male portion (52a) located on the inner surface of rear subframe (18). The inner surface of front subframe (12) contains female portion (52b). At least one of portions (52a) and (52b) are generally made of a resilient material such that they non-mechanically "snap fit" together to form a releasable, waterproof sealant/attachment means. Thus, the embodiment set forth in FIGS. 3a and 3b obviates the need for separate attachment means (19). Both FIGS. 3a and 3b allow a resilient snap fit between the front and rear subframes. When such a fit is effected, there is a smooth, unbroken flush relation between the outer surface of front subframe and the outer surface of the rear subframe. This flush relation, the lack of sharp corners or sharp edges, and the rounded nature of the outer surface of the picture, combined with its waterproof capabilities, render the child generally harmless to the frame and picture, and the frame generally harmless to the child.

Figure 4:
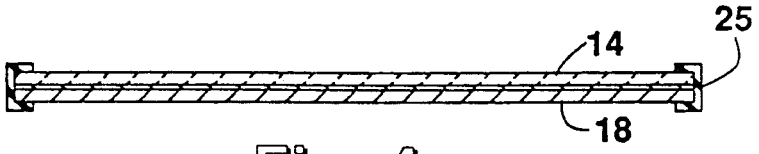
FIG. 4 is an exploded side view in cross-section of another preferred embodiment of the picture frame.

FIG. 4 illustrates another preferred embodiment of picture frame (10) in which sealant means (25) functions also as attachment means (19) to affix non-opaque sheet (14) to rear subframe (18a) without the need for a front subframe. Rear subframe (18a) may be transparent, and made of a rigid or a flexible sheet material such as plexiglass. Sealant means (25) is in the form of three sided gasket seal which would cover an outer perimeter of front face (14a) and an outer surface of rear subframe (18a) in a water sealant fashion. The entire unit may then be placed in a front subframe/rear subframe unit as described with respect to FIGS. 1–3.

Figure 5:
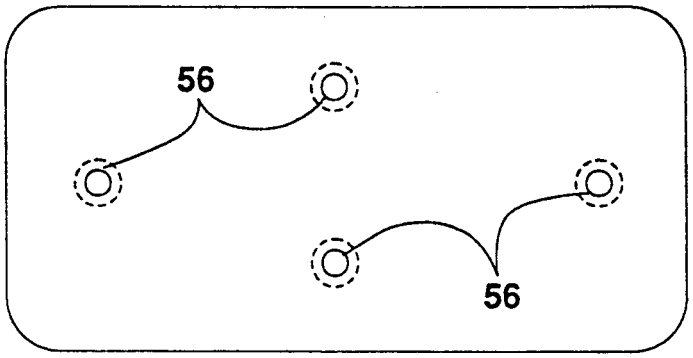
FIG. 5 is a rear elevational view of the picture frame.

FIG. 5 illustrates the rear of rectangular frames illustrated in FIGS. 2a–2d above, with wall hanging means such as holes (56) which are formed in the outer surface of rear subframe (18) to allow for the hanging of picture frame (10) to a wall. In the alternative, VELCRO strips (not shown) could be affixed to the outer surface of rear subframe (18) to allow for attaching picture frame (10) to walls but allowing for easy removal. Such releasable VELCRO attachments would allow children to non-destructively attach and remove picture from their wall, crib, or bed, etc.

Figure 6A:
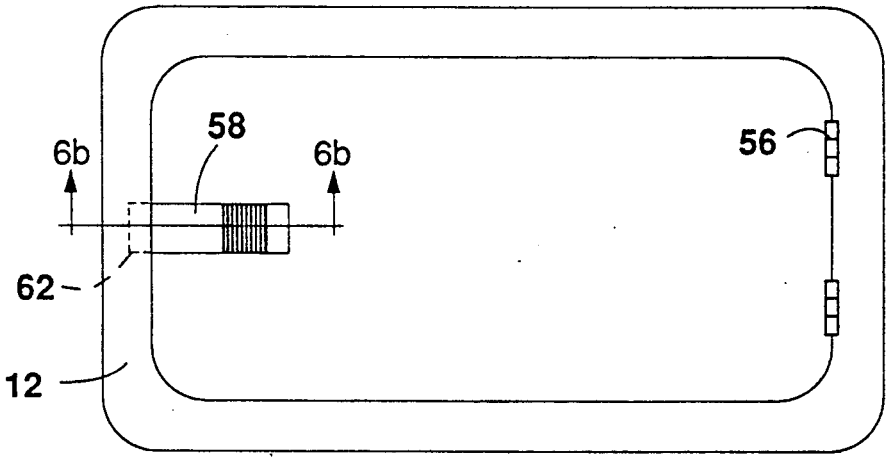
FIG. 6*a* is a rear view of the locking feature of the picture frame.
Figure 6B:
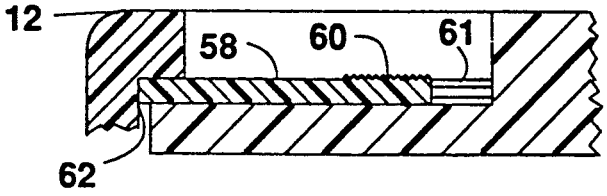
FIG. 6*b* is a side view of the locking feature of the picture frame.

FIGS. 6a and 6b illustrate yet another preferred embodiment of rear subframe (18) which contains hinge means (56) on one edge thereof and lock means (58) on the opposing side thereof. Lock means, as seen more particularly in FIG. 6b, contains sliding latch means (60), integrally attached to rails (61) of the outer surface of rear subframe (18), and dimensioned to fit within notch (62) of front subframe (12).

Figure 7A:
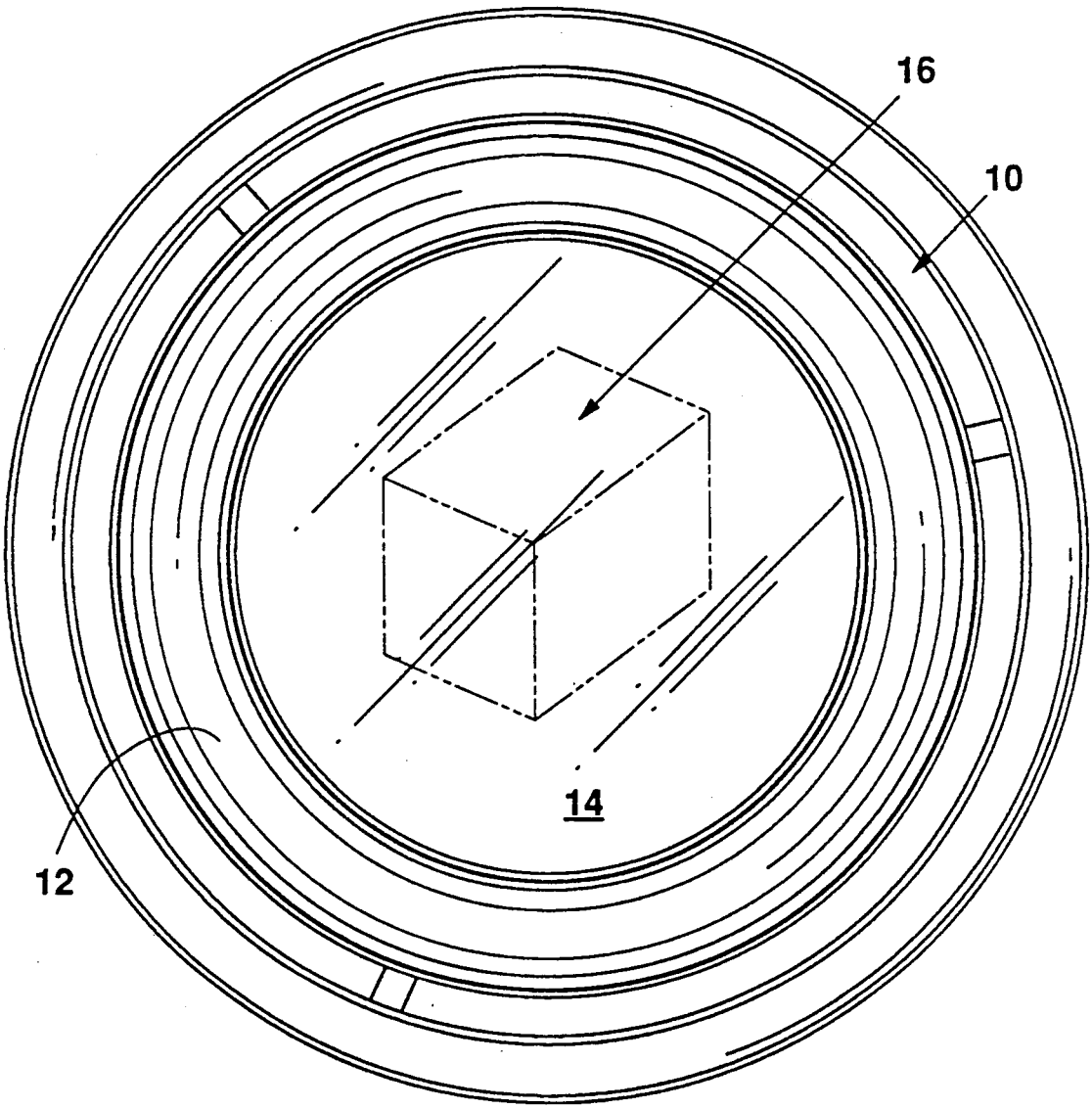
FIG. 7*a* is a front view of the picture frame incorporating an integral teething ring.
Figure 7B:
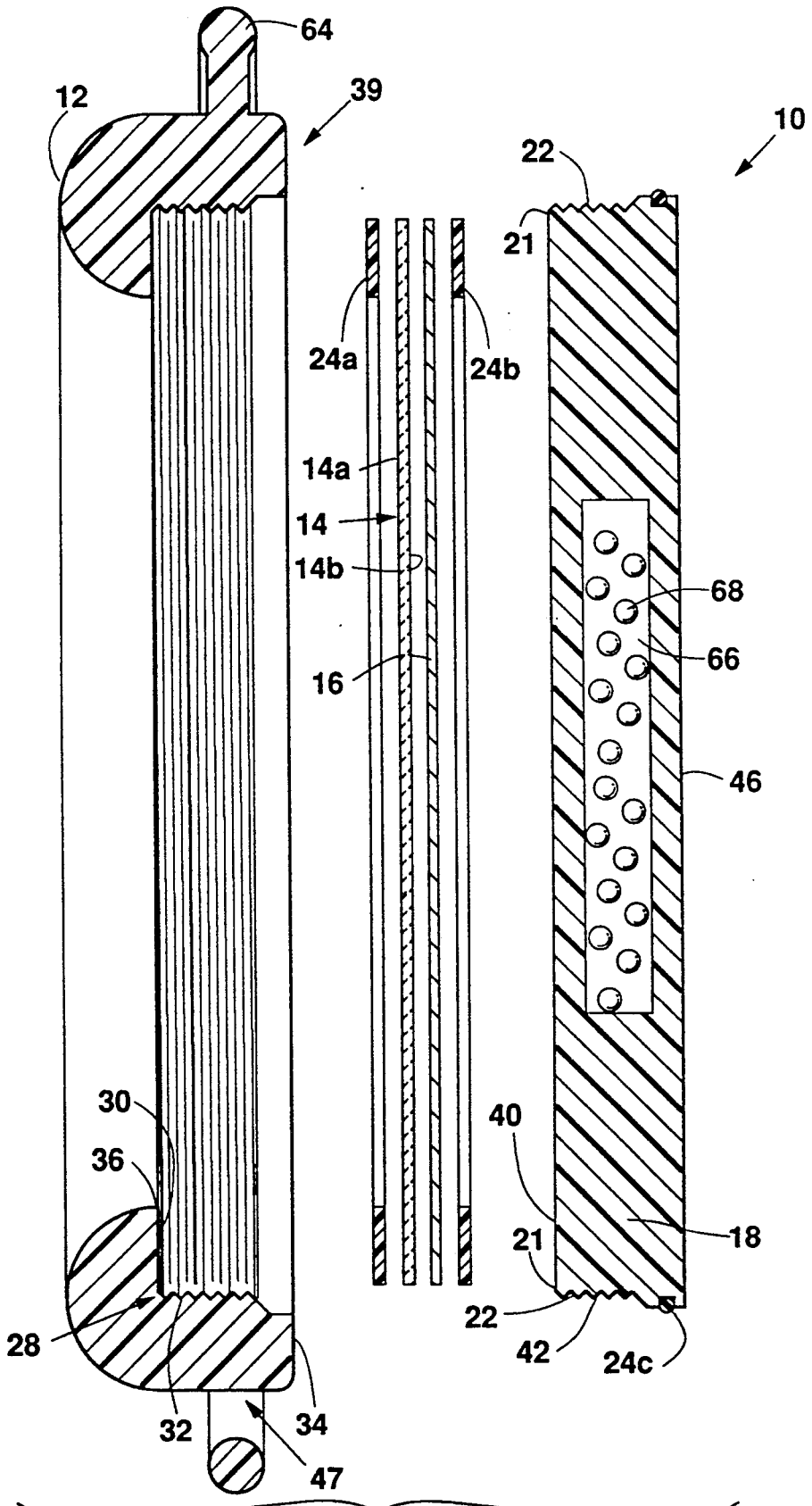
FIG. 7*b* is a cross-sectional view of the picture frame incorporating the teething ring and showing the integral rattle therein.

FIGS. 7a and 7b disclose the invention wherein front subframe (12) is integral with smooth surfaced teething ring (64). The rear subframe, as seen in FIG. 7b contains hollow section (66) which is filled with pellets (68) to form a rattle. It is to be understood that either the rattle separately or the teething ring separately may be incorporated into embodiments of Applicant's invention previously disclosed.

Figure 8:
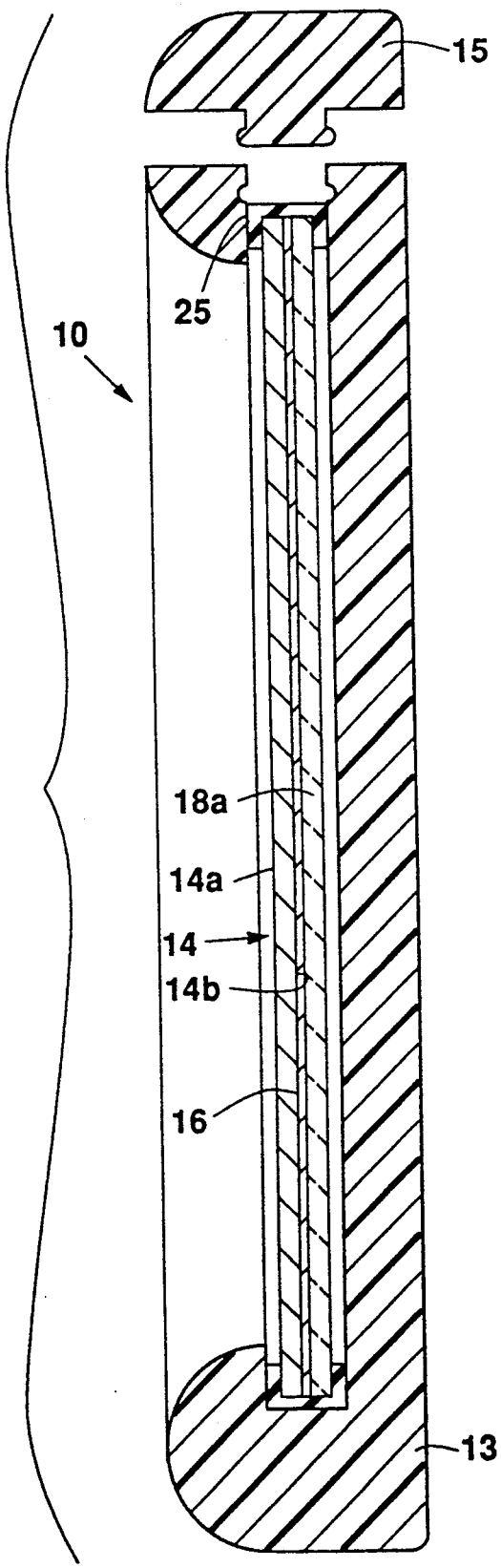
FIG. 8 is a cross-sectional view showing the picture frame with an integral front and rear subframe.

FIG. 8 discloses an alternate preferred embodiment of Applicant's invention wherein the front and rear subframe of the rectangular embodiment are integral to form means (13). Enclosing of the picture within the integral means (13) is done with enclosing members (15).

Figure 9:
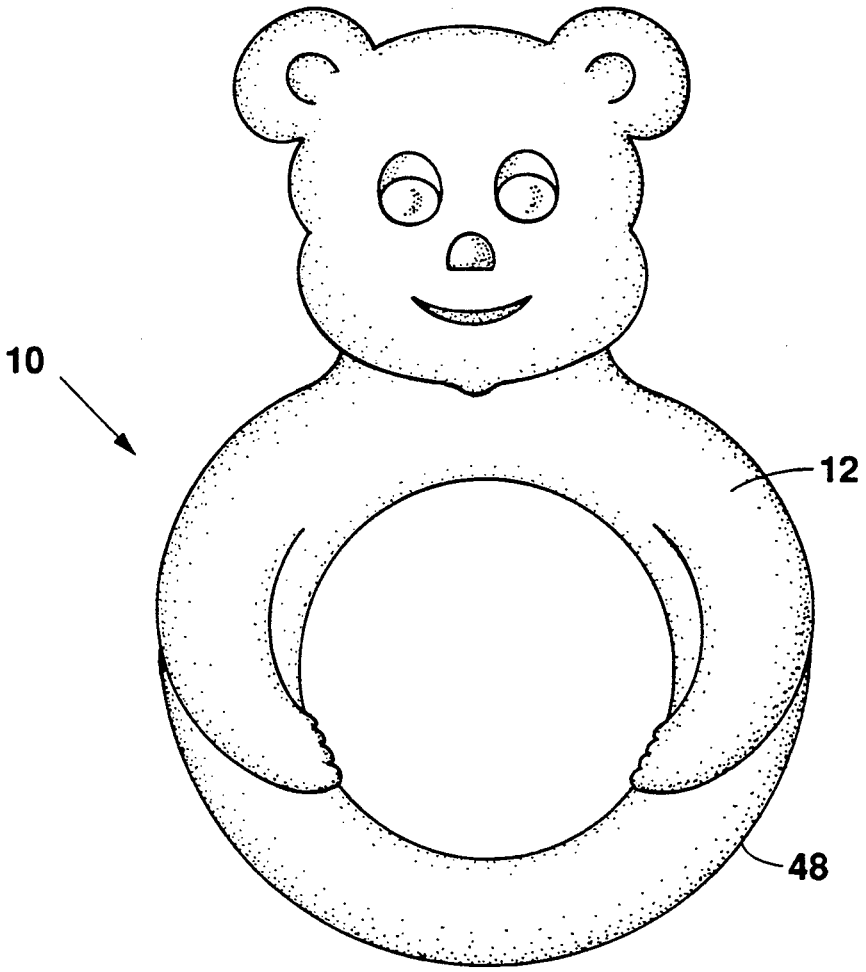
FIG. 9 is the front elevational view of the picture frame in an animal-shaped embodiment.

FIG. 9 illustrates picture frame (10) in an animal-shaped embodiment with front subframe (12) having rounded corners (48) to insure safe handling by a child.

It is to be understood that the unique features of the present invention may also be incorporated into picture frames with shapes other than those disclosed in the accompanying figures. These shapes may be animal figures such as: cats, dogs, giraffe, and fish. The shapes may also be popular cartoon characters such as: Mickey Mouse, Donald Duck.

Thus, it can be seen that all embodiments of the present invention combine waterproofing with a smooth exterior to provide a product that is safe for a child to handle.

Terms such as "left," "right," "up," "down," "bottom," "top," "front," "back," "in," "out," and the like are applicable to the embodiment shown and described in conjunction with the drawings. These terms are merely for the purposes of description and do not necessarily apply to the position or manner in which the invention may be constructed or used. Although the invention has been described in connection with the preferred embodiment, it is not intended to limit the invention to the particular form set forth, but on the contrary, it is intended to cover such alternatives, modifications, and equivalents as may be included within the spirit and scope of the invention as defined by the appended claims.

I claim:

1. A waterproof picture frame for enclosing a picture and capable of being safely handled by a child, the picture frame comprising:

a front subframe having a substantially smooth outer surface and an inner surface;

a rear subframe having a substantially smooth outer surface and an inner surface dimensioned to and capable of receiving the front subframe such that the outer surfaces join in smooth, flush relation;

a transparent sheet for viewing the picture therethrough, the sheet having a front face and a rear face, and capable of receiving the picture against the rear face thereof;

attachment means for releasably attaching the front subframe and the rear subframe;

sealant means for substantially preventing water or moisture, under normal atmospheric conditions, from reaching the picture; and a teething ring, said teething ring integral with either of said front subframe or said rear subframe.

2. The device as described in claim 1 further comprising a rattle integral with either of said front subframe or said rear subframe.

* * * * *